United States Patent [19]

Hensel et al.

[11] Patent Number: 4,702,202

[45] Date of Patent: Oct. 27, 1987

[54] LOW PROFILE INTERNALLY PACKAGED FUEL INJECTION SYSTEM FOR TWO CYCLE ENGINE

[75] Inventors: Robert J. Hensel, Oshkosh; James L. Wagner, Neenah; James M. Hundertmark; Stephen E. Sheridan, both of Fond du Lac; David W. Heidel, Green Lake, all of Wis.

[73] Assignee: Brunswick Corporation, Skokie, Ill.

[21] Appl. No.: 900,595

[22] Filed: Aug. 26, 1986

[51] Int. Cl.[4] ..... F02B 33/04

[52] U.S. Cl. ..... 123/52 M; 123/52 MC; 123/73 A; 123/456

[58] Field of Search ..... 123/73 A, 52 M, 73 AV, 123/456, 52 ML, 52 MV, 52 MC, 52 MB

[56] References Cited

U.S. PATENT DOCUMENTS

| | | | |
|---|---|---|---|
| 2,890,692 | 6/1959 | Strang | 123/382 |
| 3,190,271 | 6/1965 | Gudmundsen | 123/73 B |
| 4,227,492 | 1/1980 | Haase | 123/73 A |
| 4,290,394 | 9/1981 | Frank et al. | 123/73 A |
| 4,401,063 | 8/1983 | Haase | 123/73 B |
| 4,498,434 | 2/1985 | Baltz et al. | 123/187.5 R |
| 4,601,275 | 7/1986 | Weinand | 123/456 |

FOREIGN PATENT DOCUMENTS 0110845 7/1983 Japan ..... 123/73 A

*Primary Examiner*—Craig R. Feinberg
*Assistant Examiner*—David A. Okonsky
*Attorney, Agent, or Firm*—Andrus, Sceales, Starke & Sawall

[57] ABSTRACT

In a two cycle internal combustion engine (2), a fuel injection system is provided with a low profile compact intake manifold (22) mounted to the crankcase (8) by an adaptor plate (24) and defining an intake air flow path in a first direction (28) behind the manifold (22) through a gap between the manifold (22) and the crankcase (8) provided by the adaptor plate (24). Intake air then flows (32) into throttle bore passages (30) from behind the manifold and then reverses direction and flows through supply passages (34) having fuel injectors (38) and then into the crankcase (8). The passages share a common plenum (42) within the manifold. The fuel injectors (38), their electrical connectors (48) and a common rigid fuel supply rail (44) are all in the common plenum (42) entirely within the low profile manifold (22) and sealed from moisture and salt in a marine environment.

19 Claims, 7 Drawing Figures

LOW PROFILE INTERNALLY PACKAGED FUEL INJECTION SYSTEM FOR TWO CYCLE ENGINE

BACKGROUND AND SUMMARY

The invention relates to a fuel injection system for a two cycle internal combustion engine, including a marine drive with a vertical crankshaft.

The invention provides a low profile compact construction which is space efficient. The invention further provides a packaging system mounting the fuel injectors and their electrical connections within the intake manifold plenum, which is particularly desirable in a marine environment to protect the injectors and their connections from moisture, salt, etc.

DETAILED DESCRIPTION

Figure 1:
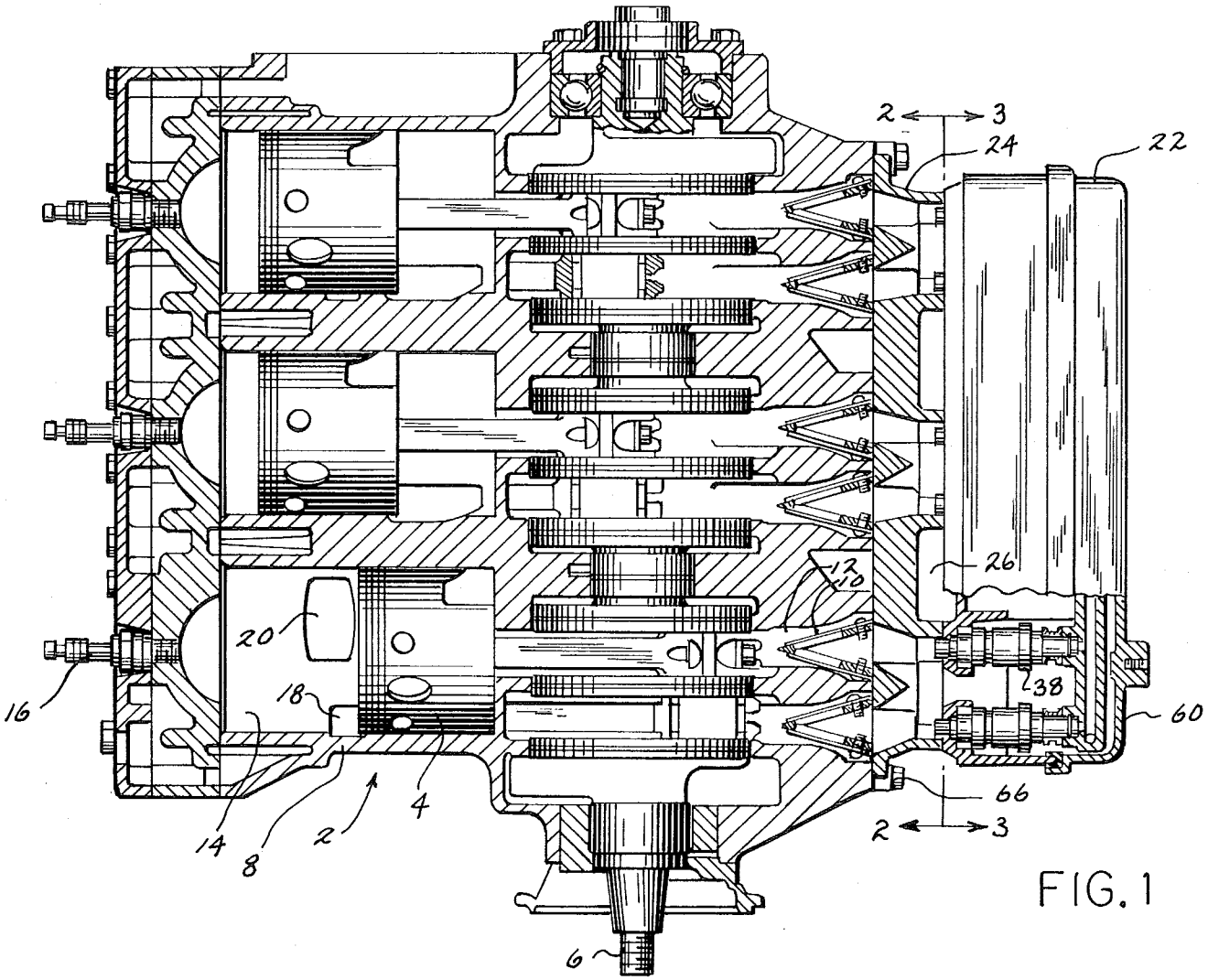
FIG. 1 is a partial elevation and partial section view showing a two cycle internal combustion engine with a fuel injection system in accordance with the invention.

FIG. 1 shows a two cycle internal combustion engine 2 having a plurality of reciprocal pistons 4 connected to a vertical crankshaft 6 in a cylinder block 8. FIG. 1 shows one bank of three cylinders in a V-6 engine. Piston 4 moves leftwardly during its intake stroke drawing a fuel-air mixture leftwardly through one-way reed valves 10 into crankcase chamber 12. Leftward piston movement also compresses the fuelair mixture in cylinder 14 for ignition by spark plug 16, which combustion drives piston 4 rightwardly generating its power stroke. During rightward movement of piston 4, the fuel-air mixture in crankcase chamber 12 is blocked by one-way reed valves 10 from exiting rightwardly and instead is driven through a transfer passage in the crankcase to port 18 in cylinder 14 for compression during the intake stroke, and so on to repeat the cycle, all as is well known. The combustion products are exhausted at port 20.

Figure 6:
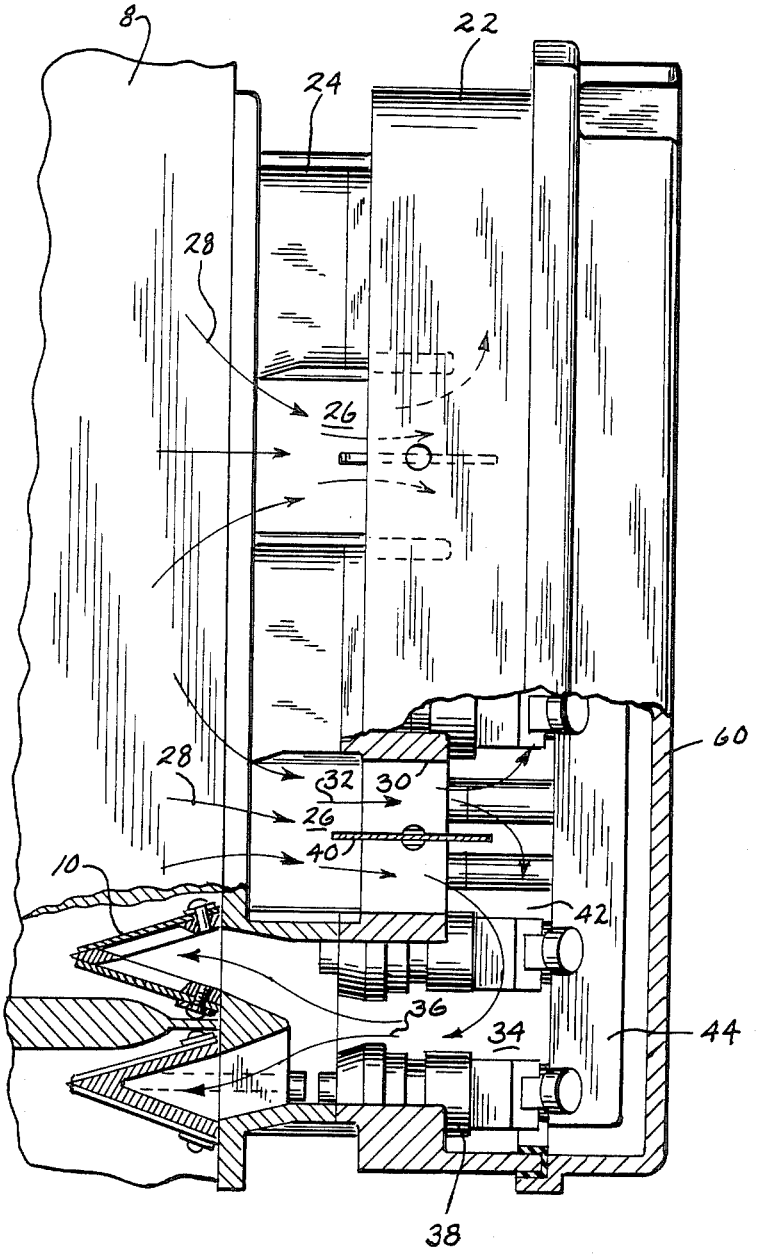
FIG. 6 is a partial elevation and partial section view of the fuel injection system of FIG. 1.

In accordance with the present invention, a fuel supply system is provided by a low profile intake manifold 22 mounted to crankcase 8 by an adaptor plate 24 which spaces the manifold away from the crankcase by a gap 26 providing a passage defining an intake air flow path laterally behind the manifold and adjacent the crankcase, i.e., between the manifold and crankcase as shown at air flow path 28 in FIG. 6. Intake combustion air then flows in a second direction away from the crankcase and through throttle bores 30 in the manifold, as shown at air flow path 32. Intake air then flows in a third direction through manifold passage 34 into the crankcase through reed valves 10, as shown at air flow path 36. Fuel injectors 38 are mounted in respective passages 34 for injecting fuel into the air flowing therethrough to provide a fuel-air mixture into the crankcase. Air flow direction 28 is into the page in FIGS. 1 and 6 and is transverse to vertical crankshaft 6. Air flow direction 32 is rightwardly in FIGS. 1 and 6 and is transverse to direction 28 and to crankshaft 6. Air flow direction 36 is leftward in FIGS. 1 and 6 and is opposite and parallel to direction 32. Direction 28 is defined by the passage provided by gap 26 between crankcase 8 and manifold 22. Direction 32 is defined by throttle bore passage 30 having a butterfly throttle control valve 40 for controlling the amount of air flow therethrough. Direction 36 is provided by manifold passage 34 into the crankcase through reed valves 10 in such passage at the entrance to the crankcase.

Figure 2:
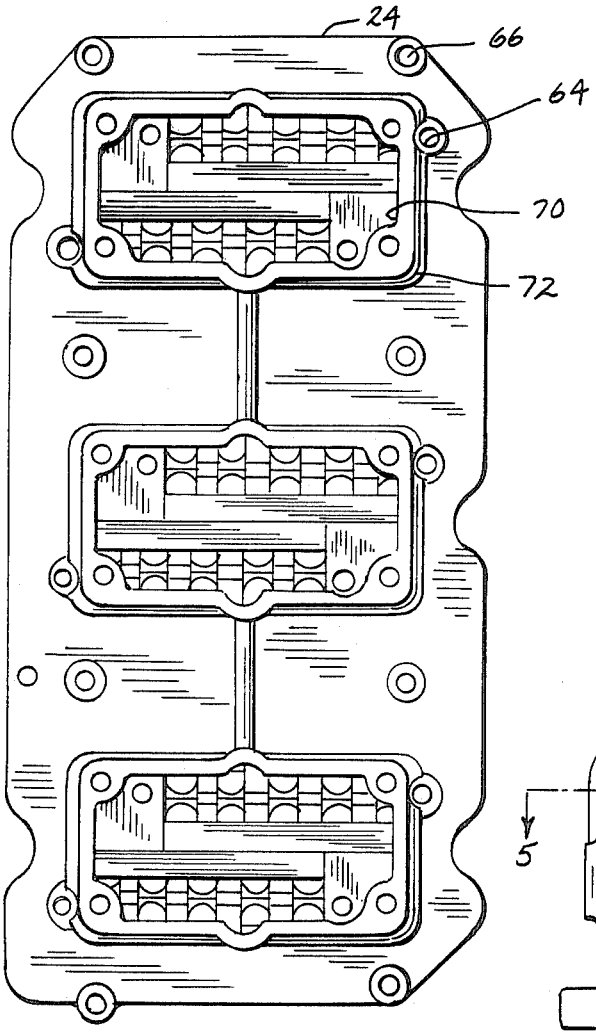
FIG. 2 is a view taken along line 2—2 of FIG. 1.
Figure 3:
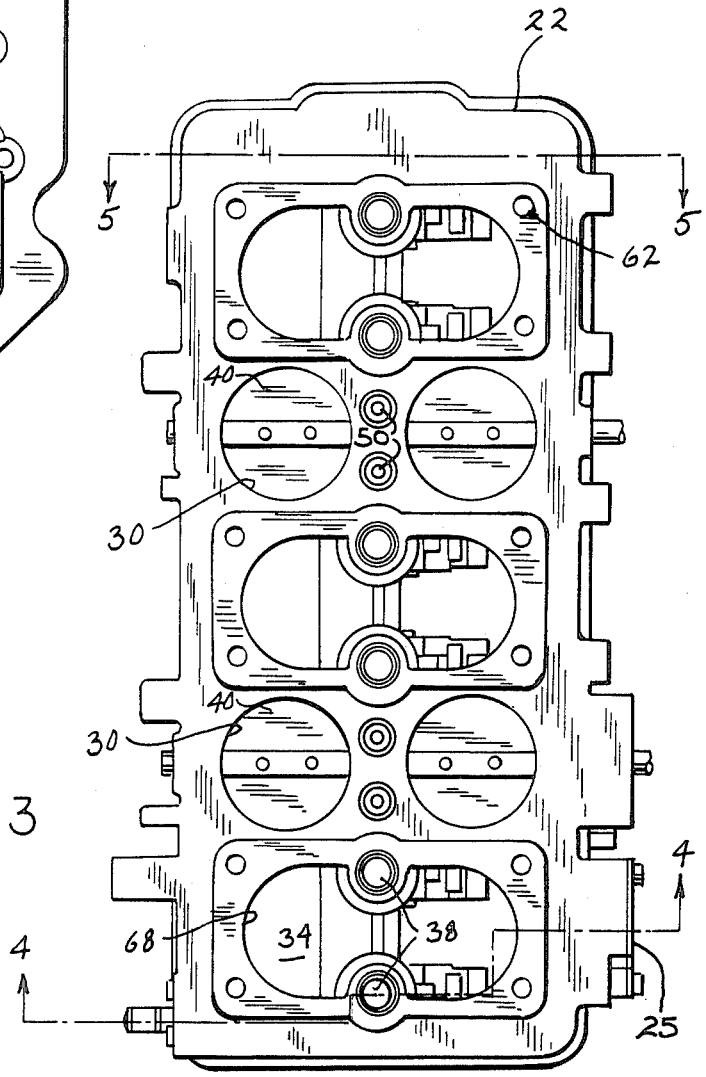
FIG. 3 is a view taken along line 3—3 of FIG. 1.
Figure 4:
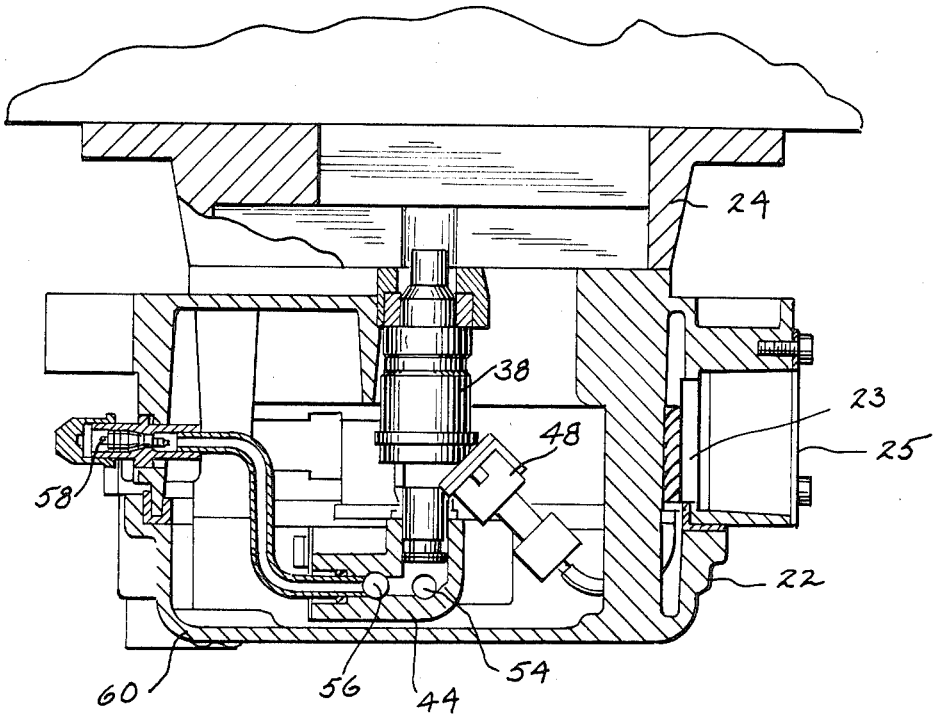
FIG. 4 is a view taken along line 4—4 of FIG. 3.
Figure 5:
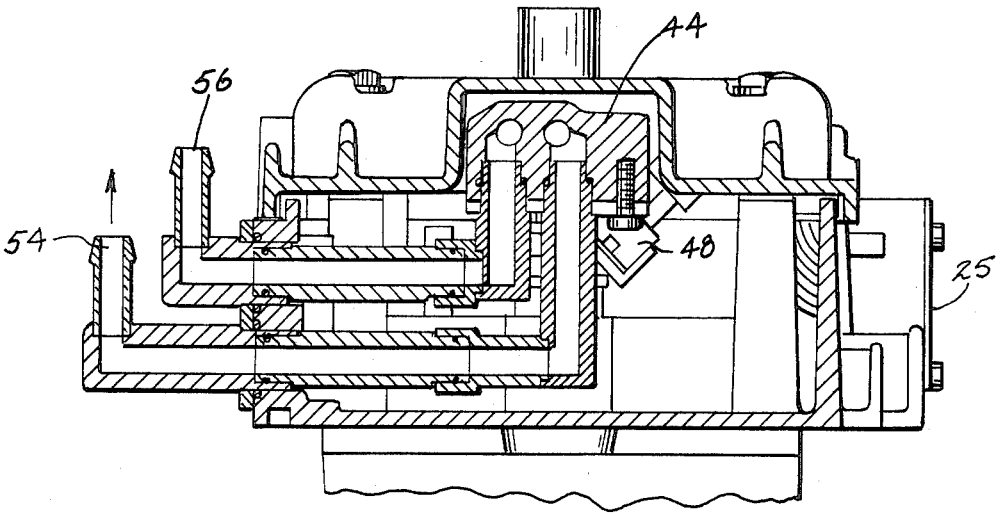
FIG. 5 is a view taken along line 5—5 of FIG. 3.
Figure 7:
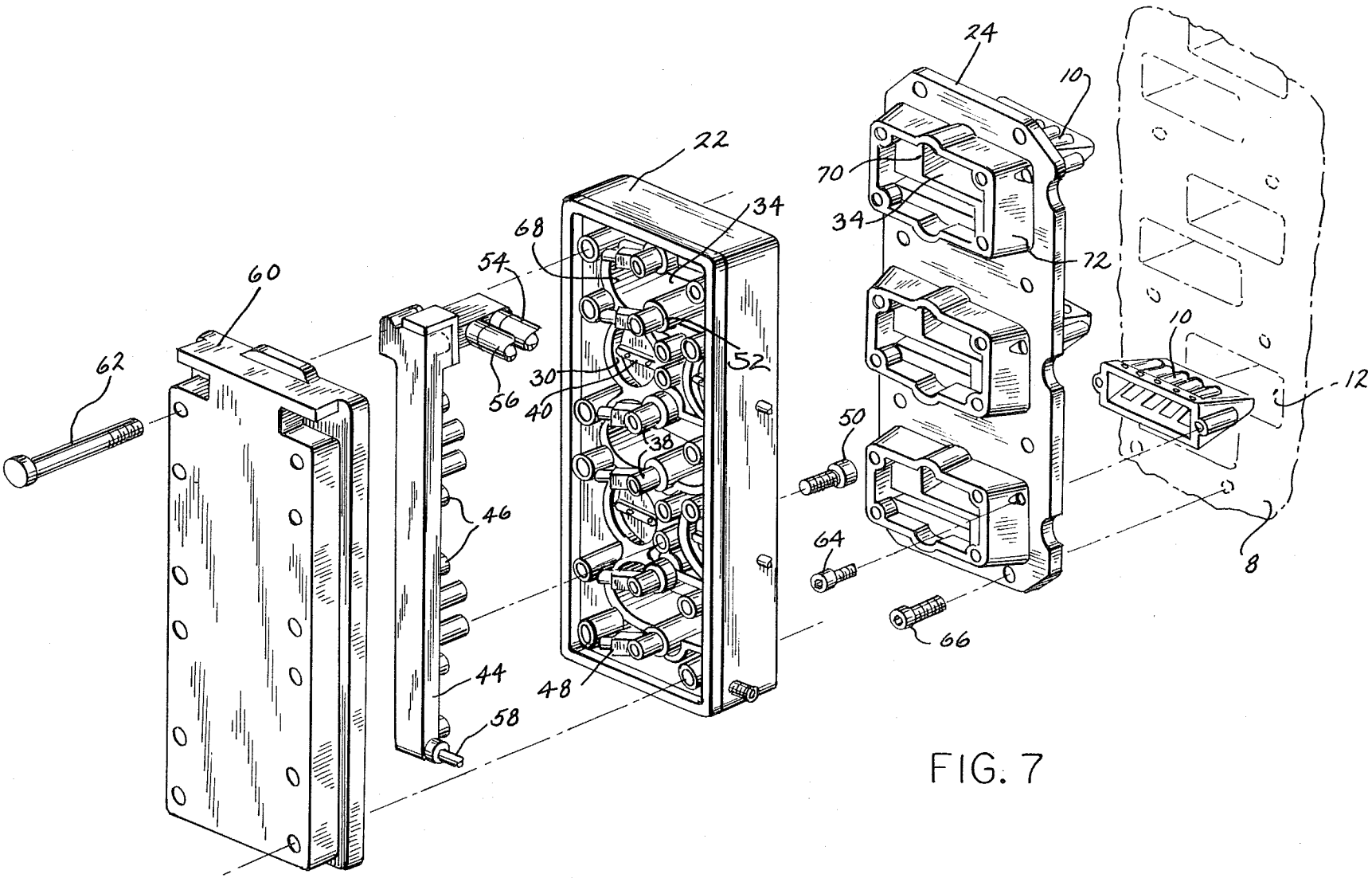
FIG. 7 is an exploded perspective view of the fuel injection system of FIG. 1.

A plurality of fuel injectors 38 are provided, one for each piston. Three supply passages 34, FIGS. 2, 3 and 7, are provided, each having two fuel injectors. Four throttle bore passages 30 are provided, each with a butterfly control valve 40. A pair of intake passages 26 are provided, each servicing two throttle bores 30. Throttle bore passages 30 and supply passages 34 interface at common plenum 42 supplying combustion air for all the pistons. All of the fuel injectors 38 are mounted within manifold 22. A common fuel supply line 44 is mounted within the manifold and supplies fuel to all of the injectors. Fuel supply line 44 is a rigid fuel rail fixedly mounted in the manifold and having discharge ports 46, FIG. 7, for respective injectors and also rigidly supporting and mounting the injectors, to be described. Fuel rail 44 is in the common plenum 42 at the interface of passages 30 and 34. The junctions 46 of fuel rail 44 with each of the injectors 38 are entirely internal to plenum 42 and manifold 22. Each injector includes an electrical connection 48, FIG. 4, for controlling injection. Each electrical connection 48 is internal to plenum 42 and manifold 22.

Fuel rail 44 is rigidly mounted to manifold 22 by bolts 50, FIG. 7. Each supply passage 34 has a pair of mounting fixtures 52 therein formed by apertures therethrough along the sidewalls of the passage, which mounting fixture apertures receive and secure the injection tip of the respective fuel injector 38. The fuel injectors 38 are thus mounted between rigid fuel rail 44 at the respective port 46 and respective manifold fixture 52. Fuel rail 44 extends vertically, parallel to crankshaft 6, and at its upper end has an inlet port 54 for receiving fuel from a fuel pump and a return exit port 56 for recirculating the fuel not discharged at ports 46. At the bottom of fuel rail 44 is a drainage port 58 for manually draining fuel from the system. A cover plate 60 is mounted by bolts 62 on the manifold to enclose the plenum and fuel injectors. Bolts 62 also mount the manifold to adaptor plate 24. Bolts 64 mount reed valves 10 to adaptor plate 24. Bolts 66 mount adaptor plate 24 to crankcase 8. The wiring harness for connectors 48 is brought out through an opening 23 in the sidewall of manifold 22 and are covered by an apertured plate 25.

Fuel-air supply passage 34 is provided through bore 68 in manifold 22 and through a bore in adaptor plate 24 formed by opening 70 therein with an encompassing raised wall 72 therearound extending leftwardly in FIG. 7 from adaptor plate 24. Raised wall 72 spaces manifold 22 from adaptor plate 24 by the above noted gap 26 to provide intake air flow path 28, FIG. 6. Air flow path 36 through passage 34 is provided along the interior of raised wall 72. Air flow path 28 through passage 26 is provided along the exterior of raised wall 72 between the next adjacent raised wall and between the adaptor plate and the manifold.

In the preferred embodiment, the fuel injectors inject fuel upstream of the reed valves 10 as shown. In an alternative embodiment, fuel is injected downstream of the reed valves, with the fuel injectors mounted to the crankcase or mounted to reed valves 10 with the injection tip in the crankcase downstream of the flaps.

It is recognized that various equivalents, alternatives and modifications are possible within the scope of the appended claims.

We claim:

1. In a two cycle internal combustion engine having a reciprocal piston connected to a crankshaft in a crankcase, fuel supply means comprising fuel injection means, and a low profile intake manifold mounted to said crankcase and defining passage means for intake air flowing in a first direction adjacent said crankcase and then flowing in a second direction away from said crankcase and then flowing in a third direction into said crankcase.

2. The invention according to claim 1 wherein said first direction is transverse to said crankshaft, said second direction is transverse to said first direction and to said crankshaft, and said third direction is opposite and parallel to said second direction.

3. The invention according to claim 2 wherein said first direction is defined by a first passage between said crankcase and said manifold, said second direction is defined by a second passage having a throttle control valve for controlling the amount of air flow therethrough, and said third direction is provided by a third passage into said crankcase, and comprising one-way reed valves in said third passage at the entrance to said crankcase.

4. The invention according to claim 3 comprising a plurality of said pistons and wherein said fuel injection means comprises a plurality of fuel injectors, and comprising a plurality of said first, second and third passages, and wherein said second and third passages interface at a common plenum supplying combustion air for all of said pistons.

5. The invention according to claim 4 wherein all of said fuel injectors are mounted in said manifold, and comprising a common fuel supply line within said manifold and supplying fuel to all of said injectors.

6. The invention according to claim 5 wherein said common fuel supply line comprises a rigid fuel rail fixedly mounted in said manifold and having discharge ports for respective said injectors for supplying fuel thereto and also rigidly supporting and mounting said injectors.

7. The invention according to claim 6 wherein said fuel rail is in said common plenum at said interface of said second and third passages.

8. The invention according to claim 7 wherein the junctions of said fuel rail with each of said injectors are internal to said plenum.

9. The invention according to claim 8 wherein each said injector includes an electrical connection for controlling injection, and wherein said electrical connection is internal to said plenum.

10. The invention according to claim 2 comprising an adaptor plate mounting said manifold to said crankcase and spacing said manifold away from said crankcase by a gap providing a passage defining said first direction air flow.

11. In a two cycle internal combustion engine having a plurality of reciprocal pistons connected to a crankshaft in a crankcase, fuel supply means comprising an intake manifold mounted to said crankcase, a plurality of fuel injectors mounted in said manifold, and a common fuel rail mounted within said manifold and having discharge ports for respective said injectors, wherein the junctions of said fuel rail and said injectors are internal to said manifold, and wherein each said injector includes an electrical connection for controlling injection, and wherein each said electrical connection is internal to said manifold.

12. The invention according to claim 11 wherein said manifold defines a plurality of intake passages into said crankcase, and wherein said intake passages include mounting fixtures receiving and mounting respective said injectors, and wherein said manifold includes further mounting fixtures rigidly mounting said fuel rail, said injectors being rigidly mounted and supported between said rigid fuel rail and said first mentioned mounting fixtures.

13. The invention according to claim 12 wherein said crankshaft extends vertically, and wherein said fuel rail extends vertically and parallel to said crankshaft and spans said intake passages and includes a drainage port at the bottom thereof for draining fuel.

14. The invention according to claim 12 comprising an adaptor plate mounting said manifold to said crankcase and defining intake air passage means into said manifold and defining fuel-air passage means from said manifold into said crankcase.

15. The invention according to claim 14 comprising a plurality of one-way reed valves mounted to said adaptor plate at said fuel-air passage means and disposed in said crankcase.

16. The invention according to claim 15 wherein said adaptor plate includes a plurality of openings each defined by an encompassing raised wall extending away from said crankcase and mounting said manifold thereon, each opening providing a fuel-air passage from said manifold into said crankcase along the interior of said encompassing wall, said openings being spaced to define a gap between the exteriors of said encompassing walls and between said intake manifold and said adaptor plate to define intake air passages between the exterior surfaces of said encompassing walls into said intake manifold.

17. The invention according to claim 16 wherein said intake manifold includes intake air passages communicating with said gaps between the exterior surfaces of said encompassing raised walls of said adaptor plate, and wherein said intake manifold includes a common plenum at the interface of said intake air passages and said fuel-air passage means, and comprising throttle control valves in said intake air passages for controlling the amount of air flow therethrough.

18. In a two cycle internal combustion engine having a plurality of reciprocal pistons connected to a crankshaft in a crankcase, fuel supply means comprising an air intake manifold mounted to said crankcase, a plurality of fuel injectors mounted within said manifold, and a common fuel rail having discharge ports for respective said injectors.

19. The invention according to claim 18 wherein said common fuel rail is mounted within said manifold, and wherein the junctions of said fuel rail and said injectors are internal to said manifold.

* * * * *